US006258177B1

(12) United States Patent
Eastman, Jr. et al.

(10) Patent No.: US 6,258,177 B1
(45) Date of Patent: Jul. 10, 2001

(54) APPARATUS FOR CLEANING THE GROOVES OF LAPPING PLATES

(75) Inventors: Arnold B. Eastman, Jr.; Michael W. Shepherd, both of Vancouver, WA (US)

(73) Assignee: SEH America, Vancouver, WA (US)

( * ) Notice: Subject to any disclaimer, the term of this patent is extended or adjusted under 35 U.S.C. 154(b) by 0 days.

(21) Appl. No.: 09/281,994

(22) Filed: Mar. 29, 1999

(51) Int. Cl.[7] ..... B08B 7/04
(52) U.S. Cl. ..... 134/6; 134/145; 134/172
(58) Field of Search ..... 134/6, 34, 26, 134/145, 172; 401/261, 263, 265; 15/239, 236.01, 236.06, 236.09

(56) References Cited

U.S. PATENT DOCUMENTS 4,272,924 6/1981 Masuko et al. .
4,407,094 10/1983 Bennett et al. .
4,433,510 2/1984 Katagiri et al. .
4,918,869 4/1990 Kitta .
4,940,507 7/1990 Harbarger .
4,974,370 * 12/1990 Gosis .
5,116,152 * 5/1992 Caswell ..... 401/261
6,057,248 * 5/2000 Wu et al. ..... 438/475

FOREIGN PATENT DOCUMENTS

0849039 A2 6/1998 (EP) .

OTHER PUBLICATIONS

McMaster—Carr Catalog #103 pp. 1520–1527, 1997.

* cited by examiner

*Primary Examiner*—Alexander Markoff
(74) *Attorney, Agent, or Firm*—Douglas G. Anderson

(57) ABSTRACT

An apparatus and method for removing sedimentary waste from the grooves of a lapping machine is provided. A blade is inserted into a groove in a lapping plate, high pressure water is sprayed into the groove in the proximity of the blade, and the blade is drawn through the groove.

3 Claims, 4 Drawing Sheets

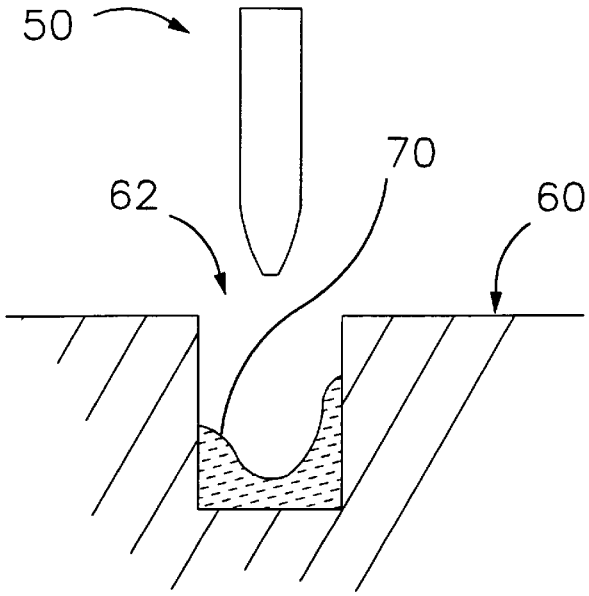
Fig. 2-a
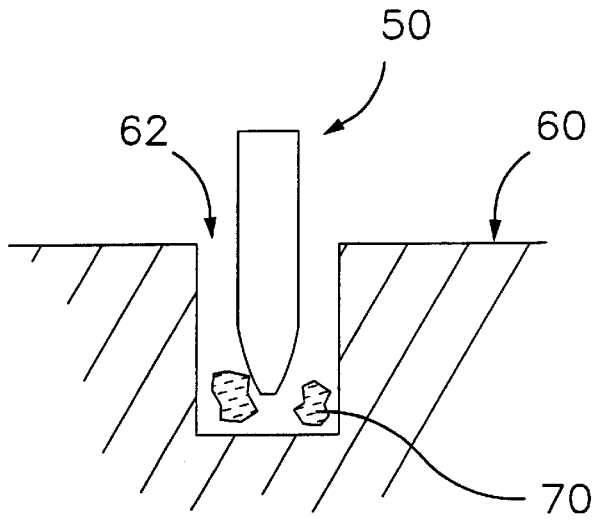
Fig. 2-b

APPARATUS FOR CLEANING THE GROOVES OF LAPPING PLATES

FIELD OF THE INVENTION

The present invention relates to an improved means and method of lapping thin wafer like materials, and more particularly to cleaning of the lapping plates.

BACKGROUND OF THE INVENTION

The preparation of semiconductor devices made from silicon, gallium-arsenide, and the like, begins with growing a monocrystalline boule. The boule is then sliced into thin disks called wafers. The wafers are then circumferentially ground, lapped, chemically etched, polished, and cleaned.

The lapping step is conventionally carried out in large orbital lapping machines that are well known in the art.

In the lapping process, the wafers are placed in circular plates called carriers. The carriers have holes prepared in them that are slightly larger in diameter than the wafer to be lapped, and are slightly thinner than the target thickness of the wafers at the end of the lap cycle. The carriers are circular shaped, and usually have gear teeth around the outside periphery. The gear teeth interact with a center gear and an annular gear such that a drive motor turning the gears causes the carrier to rotate around the center gear and around itself in an orbital motion. The wafer-containing holes in the carriers are placed toward the outer edges of the carrier such that they rotate around the center of the carrier itself during machine operation. By changing the gear ratios of the carriers, annular gear, and center gear, the direction of rotation of the carriers can be controlled and changed as needed to control flatness and wear of lapping plates.

Both the carriers, and the wafers contained within them, are supported by a bottom lapping plate. Upon starting a lap cycle, a top lapping plate lowers onto the wafers. A slurry containing an abrasive and other components such as a soap, a rust inhibitor, or a surfactant as desired, is introduced to the wafers through slurry supply holes in the top plate. One or both of the plates are typically linked to either the center gear or the annular gear such that they rotate in a controlled ratio and direction along with the center gear, annular gear, and carrier. The combined rotation of each of these items results in the wafers being moved in a circular motion within the carrier, around the carrier, and around the sun gear, with the top and bottom lapping plates rubbing against the two flat surfaces of the wafer. Wafers lapped in such a manner have very smooth and flat surfaces, with a high degree of uniformity between wafers lapped in the same cycle.

As the lap cycle continues, a force is exerted on the wafers from the top plate either from the weight of the top plate or from a mechanical means. The force exerted on the wafers, the motion of the wafers around the plates, and the abrasive in the slurry combine to lap away the surfaces of the wafer in small increments. When the desired thickness of the wafers is reached, the lap cycle is stopped, and the wafers are removed from the lap machine.

The lapping plates used for the process are typically metal, and have grooves cut into the surfaces that are in contact with the wafers. Among other functions, the grooves assist in supplying slurry to the entire surface of the wafers, carriers, and plates, and to facilitate the removal of the used slurry and residue of the lapped wafer. The grooves can be cut into the plates in many different patterns as the user desires. The grooves are typically about 5 millimeters wide, and initially about 15 millimeters deep. Over time however, the surfaces of the lapping plates are abraded away, and the grooves become much more shallow. As a result, the lapping plates either need to be replaces, or resurfaced with new grooves cut into the surfaces.

As the lap machine is used in repeated cycles, the grooves become clogged with the residue slurry and the material that has been lapped away from the wafers, plates, and carriers, inhibiting removal of the waste slurry and becoming a trap for particles and contaminants. The grooves, when clogged, create a buildup of slurry on the bottom plate that causes the wafers to float during the start of the lap cycle. Wafers then can leave the confines of the wafer carrier, and break in the lap machine. Shards of the wafer then get lodged in the residue slurry in the grooves of the bottom plate and become projectiles that can scratch wafers lapped in future cycles.

There is therefore a need of an apparatus to clean the residual slurry out of the grooves of the plates of lap machines.

SUMMARY OF THE INVENTION

The apparatus disclosed herein includes a handle attached to a rigidly attachable blade. The attachment method is such that the blade can be easily removed and a new blade installed as needed.

The apparatus disclosed herein also includes high-pressure water supply with a trigger mechanism that allows the operator to provide high pressure water to the surface of the plate in the proximity of the blade edge. A rigidly attached, interchangeable nozzle provides the desired spray pattern for delivering water to the groove of the lap plate to be cleaned.

The method of utilizing the present invention comprises positioning the blade of the apparatus in a groove of the lapping plate at one edge of the lapping plate, activating the high pressure water such that the water impacts the plate groove being cleaned in the proximity of the blade, and pulling the apparatus through the entire length of the groove ending at the other edge of the lapping plate. This process is continued for each groove of lapping plate to be cleaned. The plate is then rinsed with low pressure water.

BRIEF DESCRIPTION OF THE DRAWINGS

FIG. 2*a* is an end view showing one embodiment of the groove cleaning apparatus positioned over a groove in a lapping plate.

FIG. 2*b* is an end view showing one embodiment of the groove cleaning apparatus interacting with a groove in a lapping plate

DETAILED DESCRIPTION OF THE INVENTION

Figure 1:
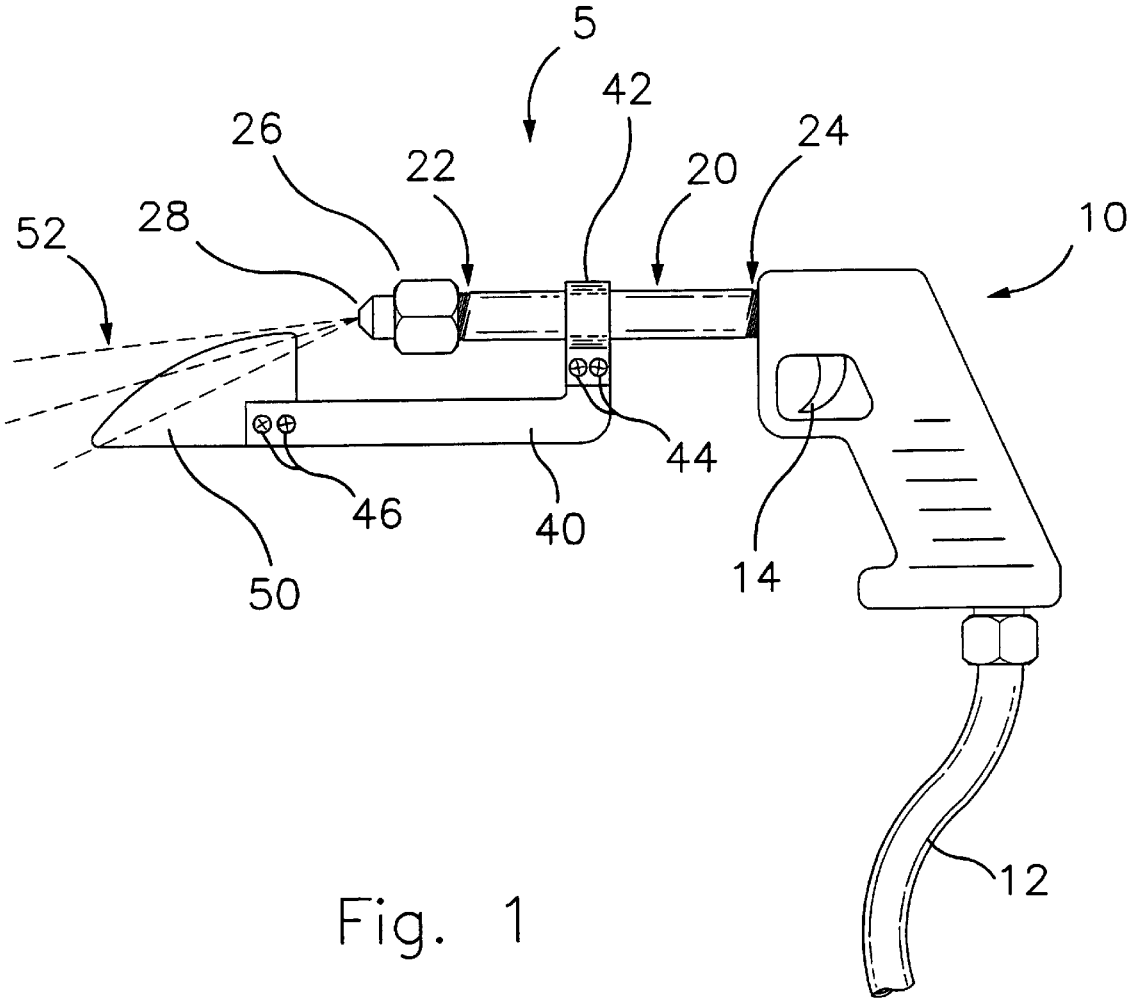
FIG. 1 is side view of an exemplary embodiment of the groove cleaning apparatus for carrying out the method of the present invention.

Turning now to FIG. 1, groove cleaning apparatus 5 includes a water hose 12 that transports water from a water pressure supply unit (not shown) to a control handle 10. A trigger mechanism 14 is used to open a valve which lets the pressurized water be projected out of the water pressure supply unit. Many such water pressure supply units are commercially available for this purpose, such as a Landa Platinum Series, Model SER 3-11021D unit. A water transmittal tube 20 is threadably attached to the control handle 10 at union 24. The other end of the water transmittal tube is attached to a coupler 26 by a threaded union 22. A nozzle 28 is then attached to the coupler 26 such that the nozzle 28 can be changed as desired to provide options of various flow patters and flow pressures. Commercially available nozzles with a variety of flow patterns are available through, for example, the McMaster-Carr catalog such as the Adjustable Spray Angle High-Pressure Nozzle Model No. 3480K21. A blade support member 40 has a circular clamp 42 that fits around and circularly encloses water transmittal tube 20. When the blade support member 40 is positioned in the desired location, it is then clamped down securely on the water transmittal tube 20 by tightening set screws 44. At the end of the blade support member 40, a blade 50 is rigidly attached by using set screws 46. For the preferred embodiment, the blade is made of a metal that is somewhat softer (as measured by a Rockwell hardness test, or equivalent mechanical measurement of material hardness) than the plate, so that if the blade is inadvertently dragged at an angle along the groove, the edge of the blade will not shave off or score the edge of the groove. Since the blade is made of a softer material than the plates, the blade will gradually wear away, and will need to be replaced periodically. Therefore securing the blade with set screws is preferable, although any method of attachment that allows for replacement is acceptable.

Now referring to FIG. 2-*a*, a blade 50 is suspended directly above the groove 62 of lapping plate 60. The sedimentary waste 70 is deposited in the bottom of the groove 62. In FIG. 2-B, the blade 50 has been lowered into the groove 62 of lapping plate 60, displacing the sedimentary waste 70.

Figure 3:
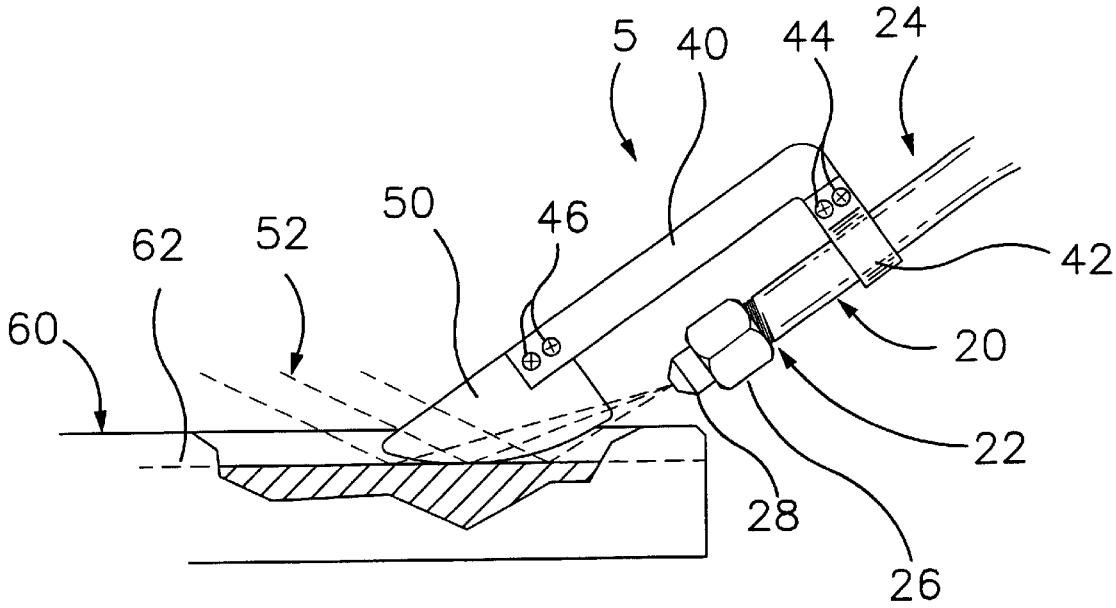
FIG. 3 is a side view showing one exemplary embodiment of the groove cleaning apparatus shown engaged in a groove of a lapping plate.

FIG. 3 depicts a side view of the groove cleaning process, wherein the blade 50 of the groove tool 5 is inserted into the groove 62 of lapping plate 60. Water from the water pressure supply unit (not shown) is enacted such that high-pressure water 52 is shot into the groove 62 immediately in front of the blade 50, and into the sedimentary waste 70. The groove tool 5 is then pulled through the groove 62 of the lapping plate 60 in a controlled form. In the preferred embodiment, the water pressure is about 1000 pounds per square inch (psi), with a flow of approximately one gallon per minute (gpm) at that pressure. It should be noted that a wide pressure range of between 50 psi and 3000 psi can be used, depending upon how compacted the sedimentary waste is. Increases or decreases in volumetric flow from 0.25 gpm to over 10 gpm again can be varied depending on the amount of sedimentary waste to be removed.

Figure 4:
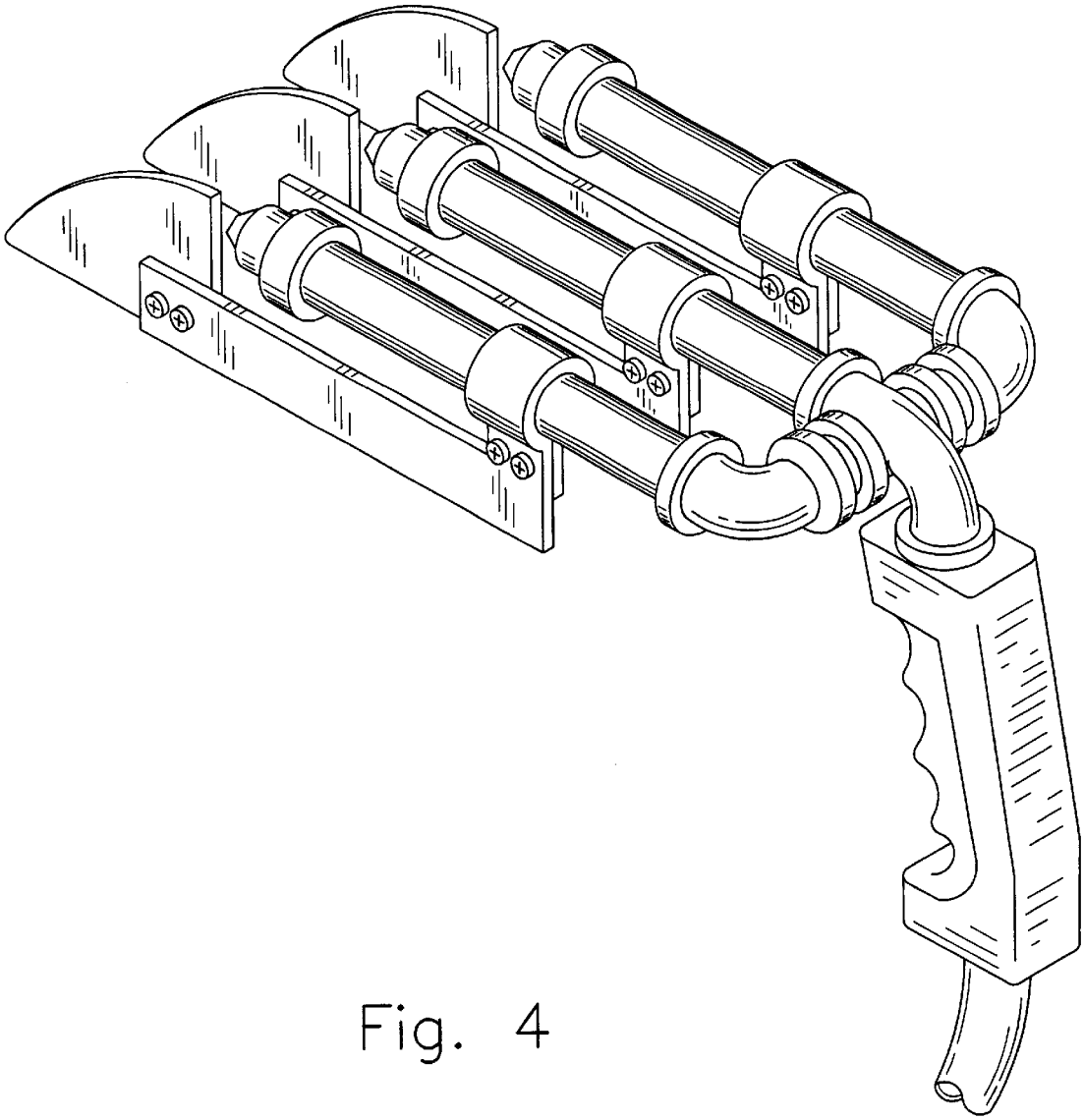
FIG. 4 is a perspective view showing one exemplary embodiment that contains multiple blades and multiple high pressure water nozzles.

FIG. 4 demonstrates an embodiment wherein there are multiple water transmittal tubes and multiple blades originating from one pressure washer, separated by a specific distance that would coordinate with the distance between grooves in a lapping plate. Although FIG. 4 shows the water transmittal tubes a fixed distance apart, the invention could be easily modified to be readily adjustable for different distances between grooves.

Various changes could be made to the invention, such as the method of attaching the blade, the shape of the apparatus, or the configuration of the parts of the apparatus while still encapsulating the inventive scope of the apparatus. As such, those skilled in the art can carry out changes and modifications to the specifically described embodiments without departing from the scope or spirit of the present invention which is intended to be limited only by the scope of the appended claims.

What is claimed is:

1. A method of cleaning a groove of a lapping plate, comprising:

a) providing pressurized water, b) providing at least one blade, and c) moving said blade through said groove in said lapping plate while inducing said pressurized water into said groove in the proximity of said blade.

2. A method of cleaning a groove according to claim 1, wherein said pressurized water is pressurized to between 50 and 3000 pounds per square inch.

3. A method of cleaning a groove according to claim 1, wherein said blade has a hardness less than or equal to the hardness of said lapping plate.

* * * * *